US011293734B2

(12) United States Patent
Maxted et al.

(10) Patent No.: US 11,293,734 B2
(45) Date of Patent: Apr. 5, 2022

(54) DOWNHOLE FIRING TOOL

(71) Applicant: GUARDIAN GLOBAL TECHNOLOGIES LIMITED, Pyle (GB)

(72) Inventors: Iain Maxted, Cowbridge (GB); Derek Paul Curnock, Bridgend (GB)

(73) Assignee: GUARDIAN GLOBAL TECHNOLOGIES LIMITED, Pyle (GB)

( * ) Notice: Subject to any disclaimer, the term of this patent is extended or adjusted under 35 U.S.C. 154(b) by 0 days.

(21) Appl. No.: 17/084,101

(22) Filed: Oct. 29, 2020

(65) Prior Publication Data

US 2021/0048284 A1 Feb. 18, 2021

Related U.S. Application Data

(62) Division of application No. 16/336,752, filed as application No. PCT/GB2017/052721 on Sep. 14, 2017, now Pat. No. 10,830,566.

(30) Foreign Application Priority Data

Sep. 26, 2016 (GB) ..... 1616280

(51) Int. Cl.
*F42D 1/04* (2006.01)
*E21B 43/1185* (2006.01)

(52) U.S. Cl.
CPC ..... *F42D 1/043* (2013.01); *E21B 43/1185* (2013.01)

(58) Field of Classification Search
CPC ..... F42D 1/043; E21B 43/1185
USPC ..... 102/200
See application file for complete search history.

(56) References Cited

U.S. PATENT DOCUMENTS

| | | | | |
|---|---|---|---|---|
| 4,234,768 | A | 11/1980 | Boop | |
| 4,527,636 | A * | 7/1985 | Bordon | F42D 1/055 102/217 |
| 6,105,688 | A | 8/2000 | Vaynshteyn et al. | |
| 6,283,227 | B1 | 9/2001 | Lerche et al. | |
| 6,604,584 | B2 | 8/2003 | Lerche et al. | |
| 6,637,339 | B1 | 10/2003 | Petzold et al. | |
| 7,007,756 | B2 | 3/2006 | Lerche et al. | |
| 7,066,261 | B2 | 6/2006 | Vicente et al. | |
| 7,116,542 | B2 | 10/2006 | Lerche et al. | |

(Continued)

FOREIGN PATENT DOCUMENTS

| | | | |
|---|---|---|---|
| GB | 2442975 | A | 4/2008 |
| GB | 2513934 | A | 11/2014 |

(Continued)

OTHER PUBLICATIONS

Schlumberger Brochure, "ASFS Addressable-Switch Firing System," (2014).

*Primary Examiner* — Samir Abdosh
(74) *Attorney, Agent, or Firm* — Mossman, Kumar & Tyler, P.C.

(57) ABSTRACT

The invention relates to downhole firing tools. In particular, a firing switch for a perforating gun with an EB switch port. The firing switch comprises a body portion configured to be located within the EB switch port, and an electronic addressable switch mechanically coupled to the body portion. The mechanical coupling of the body portion and electronic addressable switch may provide a substantially rigid firing switch.

17 Claims, 5 Drawing Sheets

(56) References Cited

U.S. PATENT DOCUMENTS

| | | | | |
|---|---|---|---|---|
| 7,347,278 | B2 | 3/2008 | Lerche et al. | |
| 7,530,311 | B2 | 5/2009 | Koekemoer et al. | |
| 7,565,927 | B2 | 7/2009 | Gerez et al. | |
| 8,091,447 | B2 | 1/2012 | Garabello et al. | |
| 8,157,022 | B2 | 4/2012 | Bertoja et al. | |
| 8,213,151 | B2 | 7/2012 | Nelson et al. | |
| 8,264,814 | B2 | 9/2012 | Love et al. | |
| 8,369,063 | B2 | 2/2013 | Vicente | |
| 8,576,090 | B2 | 11/2013 | Lerche et al. | |
| 8,689,868 | B2 | 4/2014 | Lerche et al. | |
| 8,884,778 | B2 | 11/2014 | Lerche et al. | |
| 8,960,288 | B2 | 2/2015 | Sampson | |
| 9,194,219 | B1 | 11/2015 | Hardesty et al. | |
| 9,291,040 | B1 * | 3/2016 | Hardesty | E21B 43/1185 |
| 9,518,454 | B2 | 12/2016 | Current et al. | |
| 9,605,937 | B2 | 3/2017 | Eitschberger et al. | |
| 9,835,015 | B2 * | 12/2017 | Hardesty | F42D 1/05 |
| 10,465,462 | B2 * | 11/2019 | Frazier | E21B 23/06 |
| 10,767,453 | B2 * | 9/2020 | Phelps | H05K 1/11 |
| 10,830,566 | B2 | 11/2020 | Maxted et al. | |
| 2015/0000509 | A1 * | 1/2015 | Current | E21B 43/116 89/1.15 |
| 2017/0009559 | A1 | 1/2017 | Spring et al. | |
| 2017/0159420 | A1 | 6/2017 | Tolman et al. | |
| 2019/0309608 | A1 * | 10/2019 | Phelps | H01R 12/714 |
| 2020/0018584 | A1 * | 1/2020 | Phelps | H05K 1/119 |
| 2020/0225014 | A1 * | 7/2020 | Maxted | E21B 43/1185 |

FOREIGN PATENT DOCUMENTS

| | | | |
|---|---|---|---|
| WO | 200020820 | A2 | 4/2000 |
| WO | 2015052509 | A2 | 4/2015 |

* cited by examiner

DOWNHOLE FIRING TOOL

CROSS REFERENCE TO RELATED APPLICATIONS

This application is a divisional application of U.S. Ser. No. 16/336,752, now U.S. Pat. No. 10,830,566 issued Nov. 10, 2020, which in turn is a 35 USC 371 filing of PCT/GB2017/052721 with an international filing date of Sep. 14, 2017, claiming priority from GB 1616280.2 with a filing date of Sep. 26, 2016, the entire disclosures of which are incorporated herein by reference in their entirety.

FIELD OF THE DISCLOSURE

The present invention concerns a firing switch. More particularly, but not exclusively, this invention concerns a firing switch for a perforating gun.

BACKGROUND OF THE INVENTION

The oil and gas industry uses perforating guns (explosive devices) to create holes in steel well casings to enable hydrocarbons to flow from a reservoir into a wellbore. Often strings coupling a plurality of perforating guns are sent downhole, in order to enable a number of clusters of holes to be created in a single downhole operation. Selective perforating is a technique widely used to individually fire perforating guns in such strings, when each gun is at the required well depth. For example, a string of five guns may be sent downhole, to a depth at which the lowest gun in the string is to be fired. The lowest gun is then fired, and the string moved to a position where the second lowest gun is at the required depth. The second lowest gun is fired, and the process repeated until each of the guns has been fired as required.

Typically, to prevent guns firing when they shouldn't, a switching mechanism is used to connect each gun in turn to the firing line. A common technique is the use of "EB switches" (so named after the Ensign-Bickford company which first invented the switch) located in the bottom of each gun which control the routing of power through the string. FIGS. 1A and 2A show a typical EB switch, and FIGS. 1B and 2B show a schematic of the electrical arrangement of the switches. Each EB switch is a cylindrical unit approximately 50 mm long with a diameter of 19 mm. Two wires emanate from one end of the cylinder and a metal pin 12 emerges from the other. The EB switch body is machined with two O-ring grooves, into which one or more O-rings are installed. The EB switch is fitted into an EB port within a gun sub which connects successive tubular guns together. The body of the EB switch and the external O-rings provide a pressure seal within the gun sub so that when a gun is fired, and holes created in the outer wall of the gun, the gun above is not flooded with well fluid. The EB switch may be held within the EB port by the use of a retaining nut. FIG. 1A shows the switch 10 before activation. A switch 10 is typically located at the lower end of a gun, with a pin 12 protruding downwards from the end of the switch 10 when the gun is in a downhole orientation. In this case, the switch 10 is present in the second gun of a string of guns, with a first gun located beneath the second gun when in a downhole orientation. In FIG. 1B a shooting line 14 connects to a downhole pin 12, and a detonator line 16 is not live. When the first gun is fired, typically on positive polarity, the pressure created by the explosive force of the first gun's detonation pushes the pin 12 into the switch 10, such that the shooting line 14 is connected to the detonator line 16 of the second gun, making the detonator of the second gun live. In such a way, the firing of the bottom (first) gun in a string makes the second gun live, and so on until each of the guns has been fired. The skilled person will appreciate that an alternative polarity diode in each of the EB switches is arranged such that the firing voltage required to fire each successive gun in the string alternates between positive and negative, so that there is no cascade of firings as the pin 12 connects the detonator line 16. FIG. 3 shows a circuit diagram of a typical gun string which uses EB switches. The skilled person will also appreciate that a setting tool may be used as the lowest device in the string, as shown in FIG. 3. To trigger the setting tool and first gun in the string, a special type of Dual Diode EB switch is used. This contains two diodes but no moving parts (such as a mechanical, pressure operated, switch). Application of positive voltage to the upper connection of the Dual Diode EB is routed directly to the igniter of the setting tool, via the EB switch's lower pin, which triggers activation of the setting tool. Subsequent application of negative voltage to the Dual Diode EB is routed to the detonator within gun one, so detonating the explosive charges therein and triggering the EB switch at the lower end of gun two to be activated as described above.

However, in the event of a misfire, it is clear that it will no longer be possible to continue the firing process, because the detonator in the gun above the misfire will not have been made live as described above.

There are a number of additional disadvantages of the mechanical/electrical EB system:

1) It is impossible to effectively check the wiring of the gun string before running in hole because only the lowest device(s) is/are connected to the cable which takes power from surface to the gun string. Until activation by pressure, none of the detonator wiring above the lowest gun is connected. Pinched or broken wires and other assembly faults are therefore not detectable until a gun misfires.
2) There is no specific ground connection provided for the detonator ground line. Some versions of the EB system offer a wire connection to the EB switch retaining nut, but this is relatively fragile and can often break, leading to a misrun.

Alternative firing solutions include electronic addressable firing switches, for example as shown in the perforating gun string in FIG. 4. In such an arrangement, an electronic addressable switch is associated with each gun, and is controlled from a surface control unit to switch power either to the gun below the gun with which the switch is associated, or to the detonator of the gun with which the switch is associated. These switches are usually located within the gun assembly, and a "dummy" EB switch is installed in the EB port of the perforating gun to provide a pressure seal between successive guns.

Addressable switches have a number of significant advantages over EB switches:

1) Each switch can be addressed and checked by a surface test unit designed to address and communicate with each switch, but which said surface tester is incapable of providing sufficient power to trigger any connected detonator;

2) If a gun misfires, the gun can be skipped and the gun above fired. In this way, only one gun may be lost, as opposed with the conventional EB system where an entire gun string and a run in hole will be lost through one gun misfiring;

Electronic addressable switches, whilst being significantly more reliable than EB switches, have a number of disadvantages:

1) Each addressable switch requires a "dummy" EB switch to be installed in the EB port of the perforating gun sub (which connects each gun to the gun above (or below)) in order to provide a pressure isolation barrier between guns.

2) EB switches and dummy EB switches are designed to hold pressure from one direction only, that is from below (guns are always fired lowest first). Bearing in mind the advantage of addressable switches, in that if a gun/switch misfires, the faulty gun can be skipped and the gun above the misfired gun triggered, a situation arises whereby the misfired gun is skipped and therefore contains atmospheric pressure. The gun above the misfired gun is then fired and floods, so it contains high pressure well fluid. The dummy EB switch at the bottom of the fired gun/top of the misfired gun is therefore subjected to pressure from above, a situation for which it is not designed. The dummy EB switch therefore allows well fluid through into the misfired gun, thereby rendering it impossible to diagnose the cause of the misfire.

3) Addressable switches utilise, typically, a slow digital telemetry system for communication between each switch and a surface control panel. This necessitates both good wire connections and a good ground connection for the switch as the ground (body of the gun) is used as the telemetry and power return. In contrast to an EB system, whereby sufficient power can often be sent from surface to overcome corroded or poor ground connections, digital telemetry systems are far more sensitive to such poor connections and an addressable switch system can fail to operate correctly in the presence of poor grounding.

4) Addressable switches such those described are relatively complex and time consuming to install, typically with at least five wires, each of which needs to be connected by a crimp or other connector in order to prepare the switch. These connections are typically: through-wire from above; through-wire to device(s) below; detonator live; detonator ground; and switch ground. It is desirable to reduce the complexity of installation as far as possible, especially considering the field conditions in which the installation may be taking place.

5) Addressable switches are expensive compared to conventional EB switches, and still require the use of a dummy EB switch to operate effectively, further increasing the cost of use.

6) Many addressable switches will include a removable short circuit, arranged to provide RF immunity when the firing switch is on the surface. This short-circuit requires removal before the gun string is run in hole. Failure to remove the short-circuit will mean that the gun misfires. It is possible that users may forget to remove the short circuits on installation, and once the gun string has been constructed, it may be impossible to check whether the short circuit remains in place without activating the switch, which would be extremely dangerous as it could fire the explosive charges on surface.

7) If employing addressable switches, two such devices are required in close proximity to the lower end of the lowest gun, in order to initiate the setting tool and the lowest gun. There is often little space for this in the gun system and suspending the electronic printed circuit board of the addressable switch in open space within the gun system can lead to shorted or damaged connecting wires.

The present invention seeks to mitigate the above-mentioned problems. Alternatively or additionally, the present invention seeks to provide an improved firing switch.

SUMMARY OF THE INVENTION

The present invention provides, according to a first aspect, a firing switch for a perforating gun with an EB switch port, the firing switch comprising:

a body portion configured to be located within the EB switch port, and an electronic addressable switch mechanically coupled to the body portion.

The use of the term "perforating gun" is used in the instance above, and the skilled person will appreciate that the term "gun sub" is, in many cases, used interchangeably in the remainder of the patent specification. The firing switch may be configured for use in an EB switch port of either a perforating gun or gun sub.

The provision of the electronic addressable switch mechanically coupled with the body portion allows easy installation of the firing switch in the perforating gun. The electronic addressable switch may be mechanically coupled to the body portion by a removable coupling, for example engagement of corresponding threaded sections, or a bayonet fitting. Alternatively, the electronic addressable switch may be mechanically coupled to the body portion by a permanent coupling, for example soldering, welding, or adhesive. The mechanical coupling of the body portion and electronic addressable switch preferably provides a substantially rigid firing switch, such that the firing switch may be easily handled and installed as a single unit. The electronic addressable switch is dimensioned such that it may be passed through or into the EB switch port of a perforating gun in order to locate the body portion of the firing switch within the EB switch port.

The electronic addressable switch may comprise a wiring interface. The wiring interface may be arranged to provide an easy and simple connection point for wiring the firing switch. The wiring for the electronic addressable switch is intended to closely mimic that of a conventional EB switch, thus making the steps for connecting it almost identical to that for a conventional EB switch and significantly reducing the potential for human error. The electronic addressable switch wiring may comprise one through wire from the gun above (as per an EB switch), one detonator live wire (as per an EB switch), and one connection to the device below (if required) via the solid pin emanating from the lower end of the addressable switch (as per an EB switch). The wiring may comprise no more than three wires in some embodiments of the invention. The only difference in wiring between an EB switch and the electronic addressable switch is the provision, from the upper end of the electronic addressable switch, of a positively grounded detonator ground wire. The electronic addressable switch may comprise a line in, a detonator firing line, a detonator ground line and a line out. The body portion may comprise a line out. The line in may be connected to the line out of the electronic addressable switch by means of one or more series pass-switches. Alternatively the line in may be connected to the detonator out by means of one or more switches, the detonator line switch(es) and the detonator ground connected to the grounded body portion by means of one or more switches, the detonator ground switch(es). The body portion may comprise an extended pin. The extended pin may comprise the line out.

The electronic addressable switch may comprise a male protrusion. The body portion of the firing switch may comprise a female receiving portion. The electronic addressable switch may be connected to the body portion by locating and fixing the male protrusion within the female receiving portion. The fixing may comprise engagement of corresponding threaded sections, or a bayonet fitting, or other conventional fixing techniques as known by the skilled person. It will also be appreciated that the male protrusion may be formed on the body portion and the female receiving portion on the electronic addressable switch. The line in on the electronic addressable switch may connect to the line out of the body portion via the mechanical connection between the electronic addressable switch and the body portion.

The electronic addressable switch may comprise a microcontroller, for example, a PIC microcontroller. The microcontroller may control aspects of the operation of the electronic addressable switch, including the application of power to a detonator. The control of application of power to a detonator may comprise a Pulse Width Modulation circuit. Those skilled in the art will appreciate that there are many types of logical, electronic controller which may replace the microcontroller described above. The addressable switch may comprise one or more electronically controlled short circuits. The short circuits may comprise one or more switches. The microcontroller may be configured to receive control signals from the line in to the electronic addressable switch. The microcontroller may be programmable to include a unique identifier, for example a unique identifier code. Alternatively, the microcontroller may be programmable to be designated an identifier by an external control device, and store the designated identifier. Such an arrangement allows straightforward configuration of a string of perforating guns including the firing switches, once the string has been assembled.

The body portion may comprise an external surface with a thread. The threaded part of the external surface may be configured to engage with a correspondingly threaded portion of an EB port. That correspondingly threaded portion of the EB port may, when used with a conventional EB switch, usually be used to retain the EB switch retaining nut. The positive ground may be configured to be wired both to the electronics of the electronic addressable switch and onwards to the ground connection of the detonator. Such an arrangement eliminates the need for a separate grounding point within the gun body or gun sub for the electronic addressable switch or detonator or igniter, that being a common point of failure. The detonator ground wire in a conventional EB switch system may be connected to some, often ill-defined, point of metal within the gun system which might, or might not, offer a low resistance ground path. Therefore, the described arrangement has clear advantages over the conventional grounding techniques.

The body portion may include a nut. The nut may be arranged to engage the body portion with the EB switch port of the gun sub or perforating gun. The nut, or other external surface on the body portion, may be threaded. The threaded section may be configured to engage with a corresponding threaded section on the gun sub or perforating gun. The body and the nut may be formed of a single piece of material. For example, the body and the nut may be forged or machined out of metal.

Providing the body portion with an integrated nut may reduce the time required to install the firing switch. Additionally, the provision of an integrated nut may reduce the number of parts which need to be tracked, stored, and/or provided by a user of the firing switch. The integrated nut may provide the firing switch with a positive ground connection to the perforating gun in which it is installed. The engagement of the body portion with the gun sub or perforating gun may ground the firing switch.

The body portion may comprise one or more seals. The seals may be arranged to seal the EB switch port of a gun sub or perforating gun when located within the EB switch port. Such an arrangement may be arranged such that detonation of an adjacent perforating gun does not flood the perforating gun above the location at which the firing switch is engaged.

The firing switch may be configured to be controlled via an addressable voltage switch. The use of an addressable voltage switch may control or otherwise limit the current and/or voltage which is sent to the firing switch. Providing such an arrangement may reduce the rating requirements for components making up the electronic addressable switch. Reducing the rating requirements may enable a smaller electronic addressable firing switch to be provided, thereby making it possible to provide a firing switch as described, particularly with reference to being able to be installed in a conventional EB switch port of a gun sub or perforating gun.

According to a second aspect of the invention there is also provided a perforating gun, the perforating gun comprising an EB switch port, and a firing switch located within and engaged with the EB switch port, the firing switch according to the first aspect of the invention.

According to a third aspect of the invention, there is provided a string of perforating guns according to the second aspect of the invention, the string of perforating guns electronically connected to and controlled by an addressable voltage switch.

According to a fourth aspect of the invention, there is provided a string of downhole devices comprising: a setting tool with an igniter, and an adjacent perforating gun with an electronic addressable firing switch, the firing switch electrically connected to, and arranged to control the igniter.

The electronic addressable firing switch may comprise one or more pass switches arranged such that closing the pass switch(es) allows current to pass from the perforating gun to the setting tool. The electronic addressable firing switch may comprise a firing switch according to the first aspect of the invention.

According to a fifth aspect of the invention, there is provided a method of configuring a downhole tool string, the lowermost downhole tool comprising a setting tool with an igniter, and a plurality of perforating guns connected in sequence, each of the perforating guns comprising an electronic addressable firing switch connected to a detonator, the electronic addressable switch also electrically connected to the adjacent downhole tool via one or more series pass switch(es), the method of configuration comprising the steps of:

1) sending an address signal to the firing switch of the topmost perforating gun, assigning that perforating gun the address "n", 2) sending a control signal to the firing switch of the topmost perforating gun, such that the pass switch is closed and the firing switch electronically connected to the adjacent, downhole tool, 3) monitoring the current change as the pass switch is closed, and when the current change indicates the adjacent, downhole tool comprises a perforating gun with a firing switch sending an address signal to the firing switch of the second topmost perforating gun, assigning that perforating gun the address "n+1", 4) repeating the above steps until the current change as the bottom most pass switch(es) is closed indicates the adjacent downhole tool is an igniter of a setting tool, 5) applying a small voltage to the igniter to confirm the presence the igniter, 6) flagging the address of the adjacent firing switch as being the lowermost firing switch and arranging it to control activation of the igniter.

The application of a small voltage to the igniter may be used to check that the expected impedance is detected.

The current applied to the igniter of the setting tool may be significantly less than the current required to activate the igniter, for example, 20%, 15%, 10%, or 5%, of the current required to activate the igniter. The resistance of the igniter may be approximately 52 Ohms. The method may comprise the use of a test unit arranged to apply closely controlled voltages/currents to the various downhole tools. The closely controlled voltages/currents may be limited to a small fraction of the voltage/current required to initiate a firing event. The voltages/currents applied by the test unit may be significantly less than the voltage/current required to initiate a firing event, for example, no more than 20%, 15%, 10%, or 5%, of the voltage/current required to initiate a firing event.

Once the tool string has been configured, and the lowermost perforating gun identified and addressed as such, the firing switch of the lowermost gun be arranged such that a specific command is required to close the pass switch(es) of that firing switch.

According to a sixth aspect, the invention provides a method of initiating a firing sequence for a gun string configured according to the fifth aspect of the invention, the method comprising the steps of:

sending a specific close signal to the firing switch of the lowermost perforating gun, such that the pass switch(es) of the firing switch is closed, and sending a firing voltage to the igniter of the setting tool via the firing switch of the lowermost perforating gun.

It will of course be appreciated that features described in relation to one aspect of the present invention may be incorporated into other aspects of the present invention. For example, the method of the invention may incorporate any of the features described with reference to the apparatus of the invention and vice versa.

BRIEF DESCRIPTION OF THE DRAWINGS

Embodiments of the present invention will now be described by way of example only with reference to the accompanying schematic drawings of which.

DETAILED DESCRIPTION

FIGS. 1 to 4 have been described above in the background to the invention.

A Firing Switch

Figure 1A:
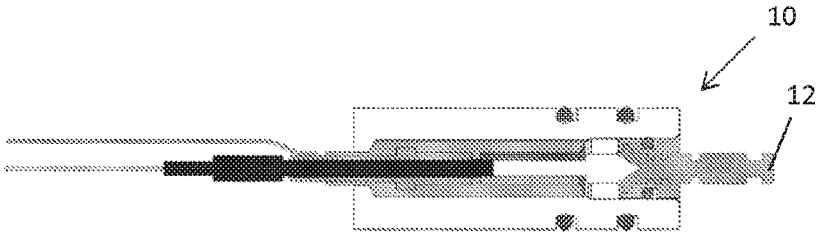
FIGS. 1A, 1B, 2A, and 2B, show a schematic view of a firing switch according to the prior art.
Figure 1B:
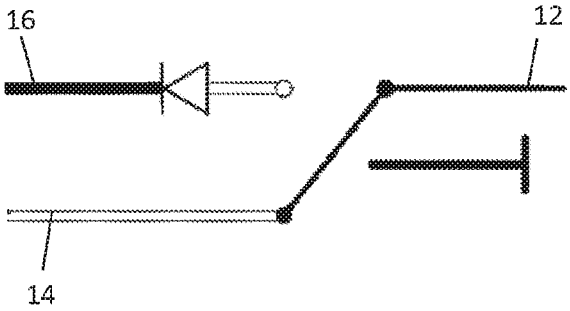
Figure 2A:
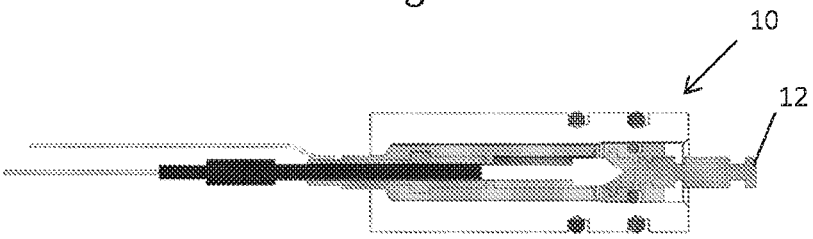
Figure 2B:
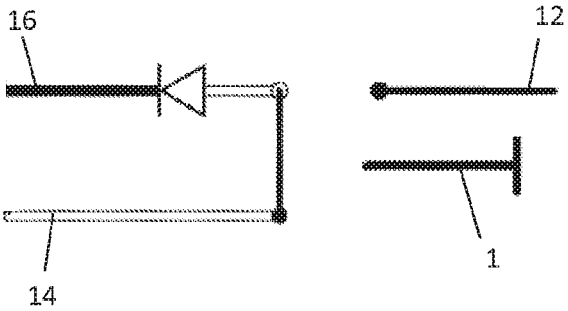
Figure 3:
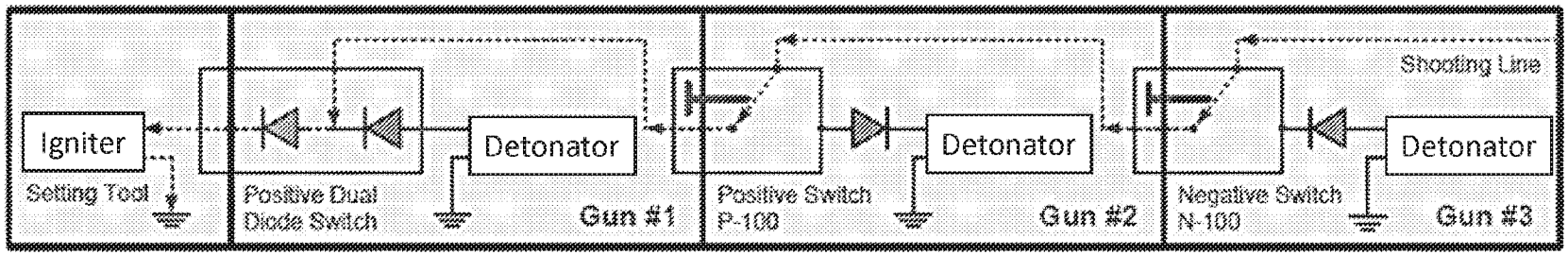
FIG. 3 shows a tool string according to the prior art.
Figure 4:
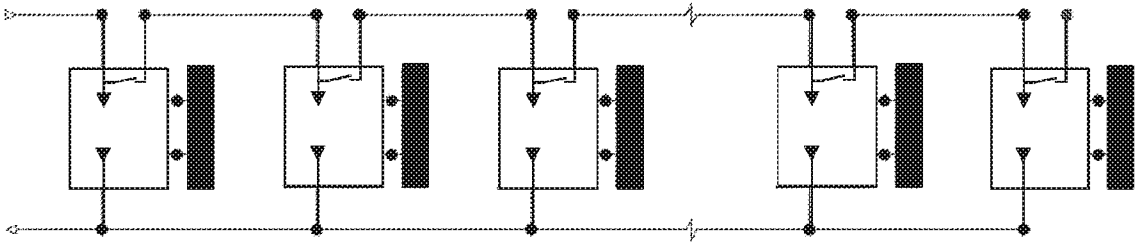
FIG. 4 shows an alternative tool string according to the prior art.
Figure 5:
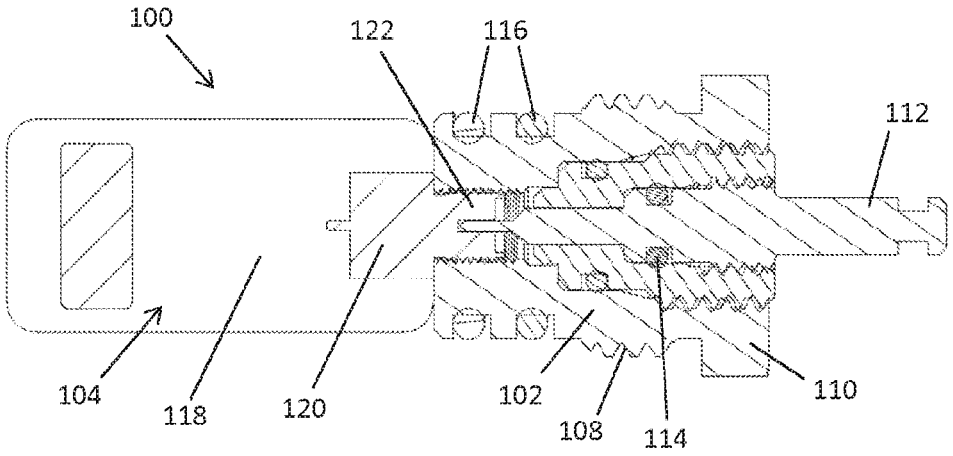
FIG. 5 shows a cross sectional view of a firing switch according to a first embodiment of the invention.

FIG. 5 shows a firing switch 100 according to a first embodiment of the invention. The firing switch 100 comprises a body portion 102 mechanically and rigidly coupled to an electronic addressable switch 104. As can be seen, the body portion 102 and electronic addressable switch 104 form a single, substantially rigid, easily installed, part. The body portion 102 comprises an approximately cylindrical outer surface 106, including a threaded section 108. A nut 110 is located towards one end of the body portion 102, away from the end of the body portion 102 mechanically coupled to the electronic addressable switch 104. The nut 110 allows the easy installation of the body portion 102 inside an EB switch port of a gun sub or perforating gun, by engagement of the threaded portion 108 with a corresponding threaded portion of the EB switch port. An end pin 112 extends from the body portion 102, away from the electronic addressable switch 104, such that the distal end of the end pin 112 extends beyond the nut 110. The end pin 112 includes an O-ring seal 114, making the connection between the body portion 102 and the end pin 114 watertight. In an alternative arrangement, the seals may be replaced by moulded sections which make the connection between the body portion 102 and the end pin 114 watertight. The cylindrical outer surface 106 of the body portion includes two O-ring seals 116 to seal the connection between the body portion 102 and the EB switch port. The provision of the sealing arrangements allows a perforating gun in which the firing switch is installed to have bi-directional pressure isolation. This allows the gun sub or perforating gun in which the firing switch is installed to be inspected in the event of a misfire. The bi-directional pressure isolation protects the gun sub or perforating gun from well fluid entry from both above and below the gun sub or perforating gun. Therefore, if an adjacent perforating gun is fired, the interior of the present perforating gun remains un-flooded. So, for example, if the perforating gun misfires, it is possible to investigate the cause of the misfire when the perforating gun returns to the surface.

The addressable electronic switch 104 comprises a printed circuit board 118 with a connection portion 120. The connection portion 120 comprises a threaded protrusion 122 which is configured to be located and engaged within a corresponding threaded receiving portion of the body portion 102. The connection portion 120 includes a line in to the electronic addressable switch 104. The end pin 112 provides a line out from the firing switch 100. The connection portion 120 therefore provides a simple and quick way of connecting the electronic addressable switch 104 and the body portion 102, both mechanically and electrically. The connection between the electronic addressable switch 104 and the body portion 102 also provides a ground for the electronic addressable switch.

Figure 6:
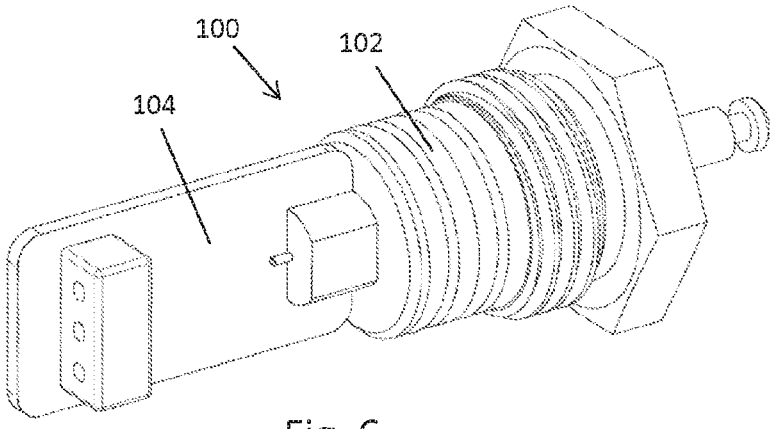
FIG. 6 shows a perspective view of the firing switch according to the first embodiment of the invention.

FIG. 6 shows a perspective view of the firing switch 100 where the body portion 102 and the electronic addressable switch 104 are mechanically coupled.

Figure 7:
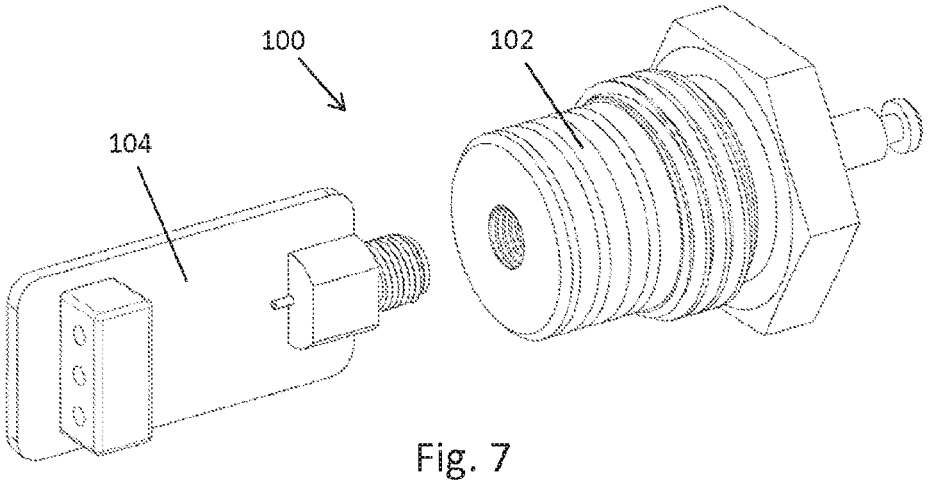
FIG. 7 shows perspective view of the firing switch prior to the mechanical coupling of the body portion and electronic addressable switch.

FIG. 7 shows the electronic addressable switch 104 prior to being screwed into the body portion 102.

Figure 8:
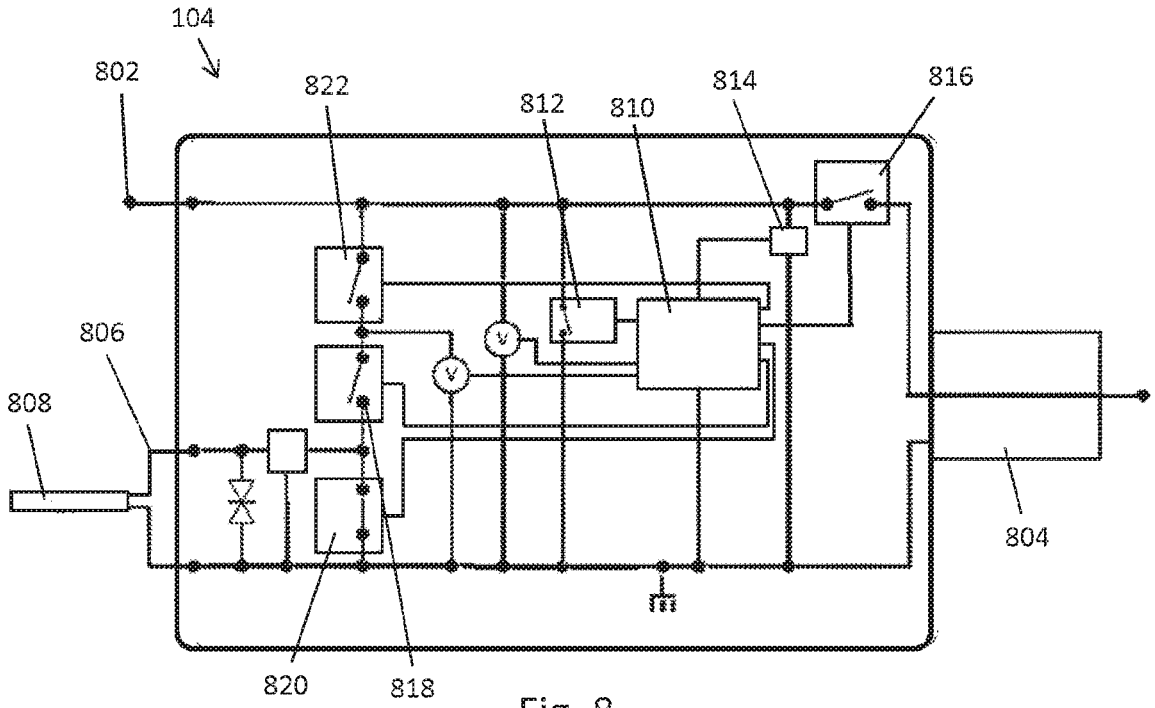
FIG. 8 shows a schematic circuit diagram of the electronic addressable switch.

FIG. 8 shows a schematic circuit diagram of the electronic addressable switch 104. The electronic addressable switch 104 comprises a printed circuit board with the layout as shown in FIG. 8. The electronic addressable switch 104 is controlled via serial communications from a surface panel through a single conductor wireline. When instructed by the surface panel, the electronic addressable switch will allow the operator to either communicate with the next switch in the string, or activate a detonator (or igniter). The electronic addressable switch 104 is connected to the wireline by a line in connection 802 and the armour of the wireline is used as a return connection. DC power and serial communications are sent via the wireline. Two outputs are provided, the line out 804 and the Det Out 806, both of which use the armour of the wireline as the return connection to the surface. The line out 804 is used to route the line in 802 to the next electronic addressable switch in the string. The Det Out 806 is controlled by the electronic addressable switch 104 to activate a detonator 808 connected between the Det Out 806 and the detonator ground connection.

Various sub circuits are shown in FIG. 8. A PIC microcontroller 810 controls the operation of the addressable electronic switch 104. The microcontroller 810 continually samples the line voltage applied to the electronic addressable switch 104 to detect communications from the surface. On receipt of a valid communications packet from the surface, it drives the COMS TX circuit 812 to provide a response to the surface, and then sets its outputs to force the various switch sub-circuits within the electronic addressable switch to change their active state to that required by the surface command. A PSU 814 regulates the line voltage to provide a stable, low voltage to the control circuitry. The COMS TX 812 converts the low voltage output from the microcontroller 810 into current changes on the line in order to provide serial communications from the electronic addressable switch 104 to the surface equipment.

A line out switch 816 comprises a normally open MOFSET switch, which is used to make or break the line passing through the module. The line out switch 816 is controlled by the microcontroller.

A first arming switch ARM SW1 818 comprising a normally open MOSFET switch allows the line voltage to be applied to the detonator 808. To close the switch 818 the microcontroller 810 applies an AC logic signal. A second arming switch ARM SW2 820 comprises a normally closed MOSFET switch. The switch 820, when closed, short circuits the two detonator wires to prevent the detonator from firing due to a fault condition or from RF interference. The switch 820 has a very low impedance when in the closed position. When opened, the line voltage may be applied to the detonator 808. To open the switch 820 the microcontroller 810 applies an AC logic signal. A third arming switch ARM SW3 822 comprises a normally open MOFSET switch. Closing of this switch 822 allows the line voltage to be applied to the detonator 808. To close the switch 822 the microcontroller 810 applies a pulse width modulated logic signal to control the rate at which the switch 822 is closed.

The electronic addressable switch 104 will power up with all sub-switches in their default state. If the electronic addressable switch 104 has previously been assigned an address it will respond and action commands to that address. If the electronic addressable switch 104 has not been allocated an address it will only respond to global (system) commands. Once the firing switch is powered up and configured the surface equipment will either be able to close the line out switch 816 or begin the detonator firing process. In order to fire a detonator the electronic addressable switch must have the line out switch 816 open and receive a series of three commands from the surface followed by an increase in line voltage, of greater than 10V, within a specified time after receipt of the first detonate command. If these criteria are not met the electronic addressable switch 104 will timeout and return to a safe state requiring the entire firing sequence to be repeated. If all of the firing criteria have been met the electronic addressable switch 104 will begin the firing process. The process will begin with the closing of the ARM SW1 switch 818, followed by the opening of the ARM SW2 switch 820. Once these two tasks have been completed the electronic addressable switch 104 will then gradually close the ARM SW3 switch to allow the voltage across the detonator 808 to rise at the pre-programmed ramp rate until it reaches the line voltage. Once line voltage has been achieved the ARM3 SW switch 822 will be fully closed allowing any changes of the line voltage to appear across the detonator 808. The electronic addressable switch 104 will remain in this state until it is powered down or the initiator is fired.

A Tool String

Figure 9:
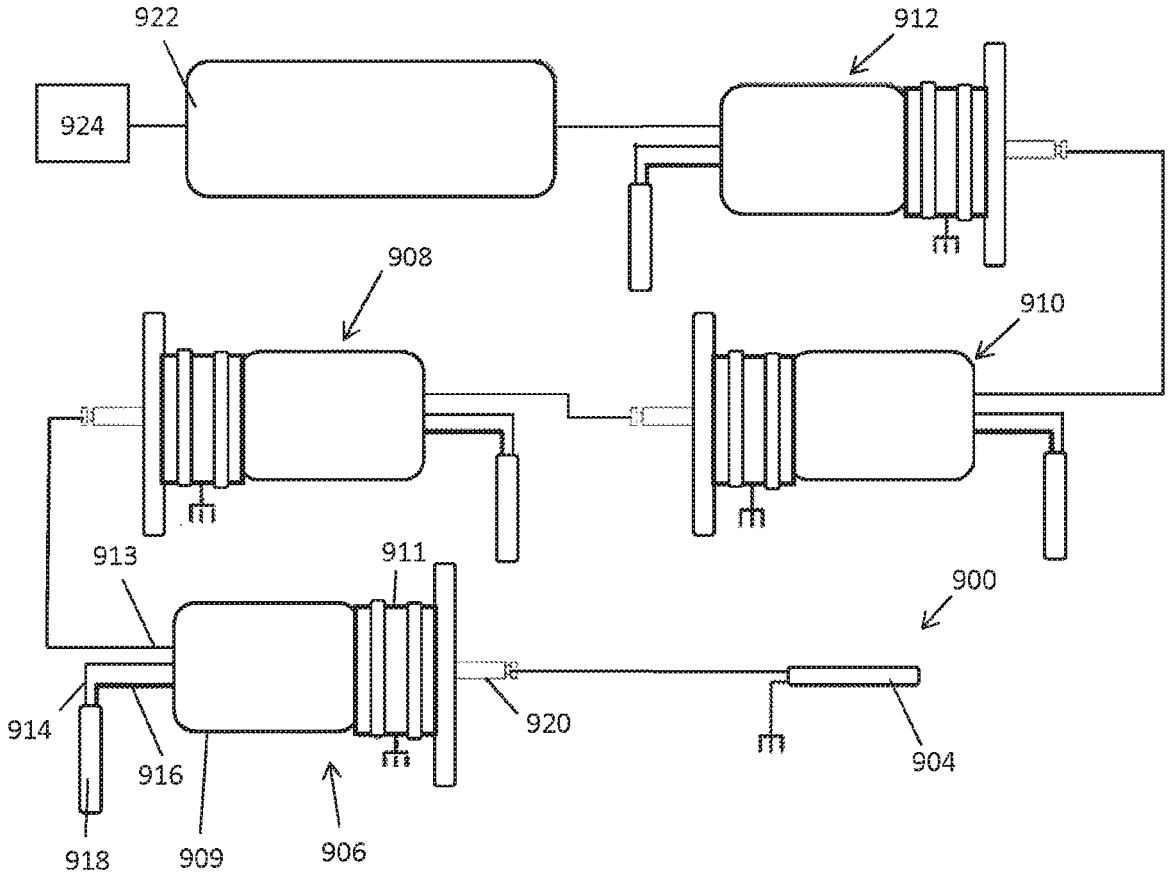
FIG. 9 shows a schematic representation of a string of four perforating guns and a setting tool according to a second embodiment of the invention.

FIG. 9 is a schematic representation of a string of four perforating guns according to a second embodiment of the invention and a setting tool. The setting tool 900 comprises an igniter 904. The igniter 904 is connected to and controlled by an electronic addressable switch 909 of the adjacent perforating gun 906. The igniter 904 is also grounded on the body of the setting tool 900. The bottom perforating gun 900 is connected to the adjacent perforating gun 906. Each of the remaining perforating guns is identical in construction, and so the description of perforating gun 906 can be applied to each of the perforating guns 908, 910, and 912.

The perforating gun 906 comprises an electronic addressable switch 909 mechanically and rigidly connected to a body portion 911. The electronic addressable switch 909 includes an interface with a line in 913, a detonator line out 914, and a detonator ground line 916. The detonator line out 914 runs to a detonator 918. The perforating gun 906 also comprises a line out 920 which extends from a pin protruding from the body portion 911. The electronic addressable switch 909 is configured to be protected by an addressable voltage switch 922 at the top of the gun string. The string of guns is arranged to be controlled by a surface panel 924. The basic function of the electronic addressable firing switch 909 is to either pass current coming into the switch via the line in 913 onto the adjacent, downhole, perforating gun 902, or to pass the current coming via the line in 913 to the detonator 918 via the detonator line 914.

A Test and Configuration Method

Before any of the firing switches can be addressed by any surface equipment equipped with a power supply of sufficient capacity to trigger a detonator or igniter, addresses must be programmed into each firing switch and in so doing, the correct wiring of each firing switch confirmed. Addresses are allocated using a surface test box, and only by using the surface test box. This is because if a gun is wired incorrectly, a surface panel could inadvertently trigger a detonator due to the wiring fault if said surface panel is able to output sufficient power to fire a detonator (typical minimum current required is 200 mA). The surface test box however, is designed with multiple separate current limiting circuits, each operating on a different principle. The absolute current which can be supplied by the surface test box is limited at half the minimum required to fire a detonator (i.e. 100 mA) but all through the testing stage of a string of firing switches according to the invention, the current is automatically limited to slightly (10 mA) more than the number of connected firing switches will require at any given time, thus the maximum current which could be applied to an incorrectly wired detonator is 10 mA.

Ensuring that the first powered device connected to a 'virgin' gun string is one that not only performs a fully automated check of all the gun string wiring, but is also one that cannot fire a detonator, guarantees that once a panel with the power capability to fire a detonator is connected, all the wiring has been confirmed as being correct.

The sequence to check, confirm, and configure a virgin gun string using a surface test box is:

1. Connect the surface test box to the topmost gun.
2. Switch on the surface test box which automatically performs a series of self-tests to confirm that all current limiting circuits are operating correctly.
3. Automatically set the surface test box current limit on all programmable current limit circuits to 1× addressable firing switch plus tolerance (Approximately 4 mA+10 mA).
4. Connect the surface test box output so powering up the first firing switch. (Note—all firing switch pass switches are set to OPEN by default so the lower pin of the first firing switch is, at this point, disconnected from the second device in the string).
5. Check that the current is as expected, displaying a warning to the operator if not.
6. Perform a communications check to the first firing switch.
7. Assign address 101 to the first firing switch.
8. Command firing switch with address 101 to perform a detonator test using its pulse width modulation circuitry.
9. Firing switch with address 101 sends back data indicating the state of its detonator output lines.
10. If firing switch with address 101 passes all tests, increase the programmable current limits by 1× firing switch.
11. Command firing switch with address 101 to close its pass switch.
12. Go to step 5 and repeat (assigning address 102, 103 etc.) until a firing switch indicates excess (4 ma<10 mA) current when its pass switch is closed (or until a fault condition is detected).
13. Assuming no fault condition is detected, on detecting increased current to the lower pin of a firing switch, command the firing switch to perform an igniter check using its pulse width modulation circuitry.
14. Firing switch 10[X] reports back the status of its igniter check. If the check passes then the firing switch is programmed as 'Last Device, Igniter Attached' and will subsequently close its pass switch only with a specific command from the surface panel.
15. Surface test unit is powered down and removed.

Once each device is programmed, communication can be established with the string (once at a safe depth in the well) using a suitable surface panel.

Figure 10:
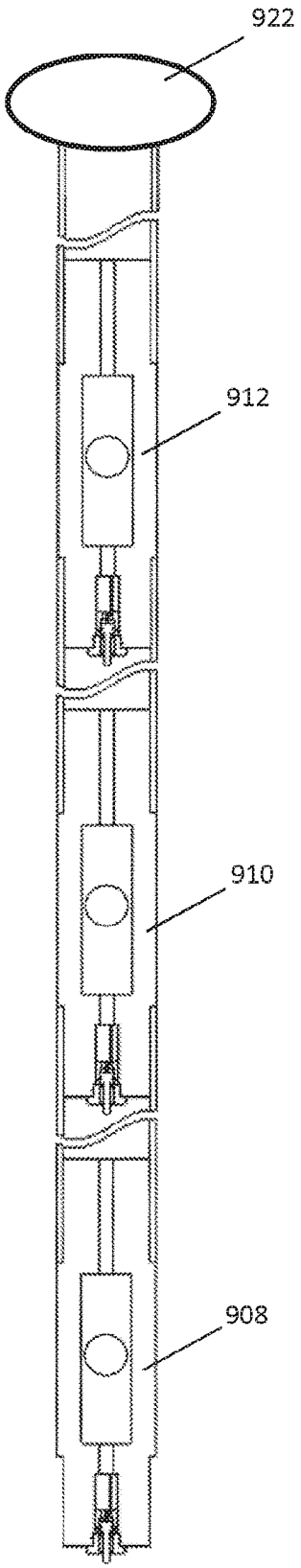
FIG. 10 shows the top three perforating guns of the string of perforating guns described with reference to FIG. 9.

FIG. 10 shows the top three perforating guns of the string of perforating guns described with reference to FIG. 9, including an addressable voltage switch 922. An installation process and operation method is now described.

The addressable voltage switch 922 is arranged to be compatible for deployment with various surface panel control units 924.

The addressable voltage switch is used when the string of guns in placed downhole, in order to limit the power applied to the firing switches downhole. At times, up to 500V may be applied by the surface panel. Allowing for losses in the resistive downhole cable, the downhole voltage seen may be reduced to between 50V and 100V. Once the detonator has fired however, the load is removed and the downhole voltage can rise to a significant proportion of the applied surface voltage. The use of the addressable voltage switch almost instantaneously limits the voltage applied to the firing switches to a maximum of 100V, which allows the components making up the firing switches to be rated to a lower voltage than would otherwise be possible.

A Firing Method

In order to fire the string of perforating guns, a command is sent to the highest firing switch 912, instructing that firing switch to close its pass switch. This applies power to the next perforating gun 910 in the string. The firing switch in the perforating gun 910 is instructed to close its pass switch, and thus power is sent down the string until it reaches the lowest firing switch in the string. The lowest of the firing switches is then instructed to close its pass switch and ramp up the pulse width modulation controlled voltage until the voltage applied to the igniter equals the downhole line voltage. The surface voltage is then ramped up until the igniter has been initiated. Power is then cut by the surface panel so opening all pass switches. The firing switches are then all sequentially powered-up again by connecting the input line to the lower pin, except for the last firing switch in the string, which does not connect power to its lower pin. The lowest firing switch is commanded to open its detonator shorting switch, close the two detonator line switches and ramp up the pulse width modulation controlled voltage until the voltage applied to the associated detonator 904 equals the downhole line voltage. The surface voltage is then ramped up until the detonator has been initiated. The PWM circuitry is included because the detonator switches were instantaneously closed, as there is already a voltage at the firing switch 912, there is a risk the detonator would draw sufficient current to cause a brown-out (low supply voltage induced reset) of the firing switch. To avoid this, as described above, the firing switch 912 includes pulse width modulation circuitry arranged to build up voltage on the detonator over a short time, so enabling the surface system to increase the surface voltage to keep pace with, and compensate for, voltage drops over the wireline.

Once the first device 900 has been fired, the same process can be used to fire any of the remaining perforating guns. As each of the switches has been allocated an address, it is possible for the surface panel to send a fire signal to whichever of the addressable firing switches is required. Also, because the detonation of a perforating gun does not flood the adjacent guns, it may be possible to skip a device in the firing sequence, for example in the event of a misfire of a detonator.

Whilst the present invention has been described and illustrated with reference to particular embodiments, it will be appreciated by those skilled in the art that the invention lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A firing switch for a perforating gun with an EB switch port, the firing switch comprising:

a body portion configured to be located within the EB switch port, and an electronic addressable switch mechanically coupled to the body portion.

2. The firing switch as claimed in claim 1, wherein the electronic addressable switch is mechanically coupled to the body portion by a removable mechanical coupling.

3. The firing switch as claimed in claim 1, wherein the electronic addressable switch is mechanically coupled to the body portion by a permanent mechanical coupling.

4. The firing switch as claimed in claim 1, wherein the mechanical coupling of the body portion and electronic addressable switch provides a substantially rigid firing switch.

5. The firing switch as claimed in claim 1, wherein the electronic addressable switch comprises a wiring interface.

6. The firing switch as claimed in claim 1, wherein the electronic addressable switch comprises a line in, a detonator firing line, and a detonator ground line.

7. The firing switch as claimed in claim 1, wherein the electronic addressable switch comprises a male protrusion, and the body portion of the firing switch comprises a female receiving portion, with the male protrusion of the electronic addressable switch being mechanically coupled to the female receiving portion of the body portion.

8. The firing switch as claimed in claim 7, wherein the mechanical coupling of the male protrusion and female receiving portion is by engagement of corresponding threaded sections.

9. The firing switch as claimed in claim 1, wherein a line in to the electronic addressable switch connects to a line out of the body portion via the mechanical connection between the electronic addressable switch and the body portion.

10. The firing switch as claimed in claim 1, wherein the electronic addressable switch comprises a microcontroller.

11. The firing switch as claimed in claim 1, wherein the electronic addressable switch comprises one or more electronically controlled short circuits.

12. The firing switch as claimed in claim 1, wherein the body portion includes a nut.

13. The firing switch as claimed in claim 1, wherein the body portion comprises one or more seals.

14. The firing switch as claimed in claim 1, wherein the firing switch is configured to be controlled by a surface panel.

15. An apparatus for firing a perforating gun string that includes at least a first gun, a second gun, and a gun sub that connects the first gun to the second gun, wherein the gun sub includes a port sized to fit a cylindrical switch that is 10 mm long and 19 mm in diameter, the apparatus comprising:

a body portion having an outer cylindrical surface and a threaded portion, the body portion being configured to seat within the port of the gun sub;

at least one sealing member configured to form a fluid seal between the outer cylindrical surface and an adjacent surface of the gun sub;

an end pin extending from the body portion; and an electronic addressable switch mechanically coupled to the body portion and electrically connected to the end pin, the electronic addressable switch including a microcontroller configured to: (i) continually sample a line voltage applied to the electronic addressable switch to detect a communication signal, (ii) drive a circuit to provide a response to the communication signal, and (iii) force one or more sub-circuits within the electronic addressable switch to change an active state to that required by the communication signal.

16. The firing switch as claimed in claim 1, wherein the electronic addressable switch comprises a male protrusion, and the body portion of the firing switch comprises a female receiving portion, with the male protrusion of the electronic addressable switch being mechanically coupled to the female receiving portion of the body portion.

17. An apparatus for perforating a formation, comprising:

a perforating gun string that includes at least a first gun and a second gun;

a gun sub connecting the first gun to the second gun, wherein the gun sub includes a port sized to fit a cylindrical switch that is 50 mm (1.97 inches) long and 19 mm (0.75 inches) in diameter; a switch including: a body portion having an outer cylindrical surface and a threaded portion, the body portion being configured seat within the port of the gun sub and connect to the gun sub at the threaded portion; at least one sealing member configured to form a fluid seal between the outer cylindrical surface and an adjacent surface of the gun sub; an end pin extending through and from the body portion; and an electronic addressable switch mechanically coupled to the body portion and electrically connected to the end pin, the electronic addressable switch including a microcontroller configured to: (i) continually sample a line voltage applied to the electronic addressable switch to detect a communication signal, (ii) drive a circuit to provide a response to the communication signal, and (iii) force one or more sub-circuits within the electronic addressable switch to change an active state to that required by the communication signal.

* * * * *